US010548381B2

(12) United States Patent
Nedjam

(10) Patent No.: US 10,548,381 B2
(45) Date of Patent: Feb. 4, 2020

(54) ALL PURPOSE CLEANING RECEPTACLE

(71) Applicant: Farid Nedjam, Overland Park, KS (US)

(72) Inventor: Farid Nedjam, Overland Park, KS (US)

( * ) Notice: Subject to any disclaimer, the term of this patent is extended or adjusted under 35 U.S.C. 154(b) by 346 days.

(21) Appl. No.: 15/208,103

(22) Filed: Jul. 12, 2016

(65) Prior Publication Data

US 2018/0014622 A1 Jan. 18, 2018

(51) Int. Cl.
*A45D 27/48* (2006.01)
*A46B 15/00* (2006.01)
*A45D 27/46* (2006.01)

(52) U.S. Cl.
CPC ..... *A45D 27/48* (2013.01); *A45D 27/46* (2013.01); *A46B 15/0091* (2013.01)

(58) Field of Classification Search
CPC ..... A45D 27/22; A45D 27/46; A46B 15/0095
See application file for complete search history.

(56) References Cited

U.S. PATENT DOCUMENTS 1,140,030 A * 5/1915 Gaisman ..... A45D 27/22 132/290
1,321,026 A * 11/1919 Freed ..... F21L 4/00 132/286
1,990,439 A * 2/1935 Murphy ..... A45D 27/28 132/314
2,366,338 A * 1/1945 Konsel ..... A45D 42/08 132/291
4,945,598 A * 8/1990 Racioppi ..... A45D 27/29 15/160
5,320,125 A * 6/1994 Barnhart ..... A45D 40/18 132/297
5,640,723 A * 6/1997 Stanek ..... A47K 3/282 297/188.1
6,062,970 A * 5/2000 Back ..... B24D 15/10 451/556
6,131,230 A * 10/2000 Manabat ..... A45D 27/46 15/104.92
6,886,211 B2 * 5/2005 Severino ..... A45D 27/46 15/210.1
8,607,396 B2 * 12/2013 Albright ..... A47L 21/04 15/104.92

* cited by examiner

*Primary Examiner* — Sarah B McPartlin

(57) ABSTRACT

A container that houses a brush submerged in water or any other non toxic cleaning liquid. A brush inside this container will help facilitate the cleaning of any small object with a hard to reach gap or intricate cavity. A top cover that provides additional accessories needed to make it an all in one shaving and grooming experience. In our present application, it would be the gap between the blades on a disposable or a double edge safety razor.

1 Claim, 18 Drawing Sheets

ALL PURPOSE CLEANING RECEPTACLE

BACKGROUND OF THE INVENTION

1. Field of the Invention

This invention is generally related to manual razor cleaning devices, and more specifically to a novel approach to clean razor blades. For many of us shaving is a daily ritual that involves basic accessories such as a razor, shaving cream, and running water. In this present invention, we will namely be describing the challenges associated with shaving using a disposable or double edge safety razors. This present invention is not designed to be used with razors that use electricity or any other energy based source such as laser technology.

When shaving with disposable razors or double edge safety razors, the grime, a mixture of shaving cream and hair clippings, builds up as soon as the blades clip the hair; facial or otherwise. This grime ends up clogging the gap that separates the blades, as well as the razor head's structural housing rendering the shaving process inefficient. It is for the aforementioned reason that for disposable razors to work as intended, the blades must be sharp, and be cleaned as often as possible during the shaving process.

In general when people shave, they use running water to clean the blades on a razor. This cleaning process rarely gets the razor head entirely grime free. In most cases, it only clears the shaving foam and partially removes the grime stuck between the blades. This is the reason why many people resort to hitting the razor's handle against the edge of the sink to forcefully expel the grime stuck between the blades.

Shaving longer hair is even harder on razor blades. It not only wears them out faster due to the fact that several shaving passes over the same area might be needed to obtain the desired shave, but requires additional rinsing as the gap between the blades fills up quickly, with the longer hair being trapped in the razor head making the shaving process even more tedious. Shaving under the above conditions translates into longer shaving time and more water going to waste.

As for individuals who use disposable razors equipped with push buttons; they certainly can observe an improved cleaning functionality, however it is not always sufficient to get the stubborn grime out.

In addition to the cleaning challenges mentioned above, and if one intends on reusing the same disposable razor more than once, then there must be no grime deposits left on the blades in order to prevent metal corrosion.

In summary, clearing the grime on a razor head is a tedious but necessary process. Improving greatly on this cleaning process would make shaving less of a chore, and with that said, bring the water usage to a minimum.

2. Past Related Art

U.S. Pat. No. 4,890,348 issued to Racioppi describe the use of a brush connected to a suction cup via a structural stem. The brush can be attached to a pop up drain stopper through the use of the suction cup found on its base and which aligns with the nozzle of a faucet.

U.S. Pat. No. 4,945,598 issued to Racioppi too, describes the use of the same type of cleaning device, but configured to be attached in bathtub or shower enclosure.

U.S. Pat. No. 6,131,230, issued to Manabat shows a container having a cavity with one lower portion container a cleaning solution, and an upper portion with an access slot used to guide a safety razor, a lever activating a rotary brush, an elevated brush held within the upper housing allowing the blades of the razor to be cleaned.

Manabat's is an improvement over Racciopi art in terms of having a cleaning solution contained in a tank, but may only work for certain types of razors. Furthermore, the elongated brush pushes the grime forward from the lower blade of a disposable razor. The grime is then being wiped by the rotating brush that is activated by the push down action through the use of a tubular stem that is held in a raised position by the action of a spring built into the container. This process seem to require the use of both hands in order to achieve the cleaning. Also, for the elongated brush as illustrated in FIG. 7 element 42 to function as intended; the razor blades must be exposed from the backside of the razor head and positioned parallel to the bristles of the brush to allow the grime to be expelled. For the blades to align with the brush, the razor would have to be tilted to an almost 90 degree angle which would not be possible with the indicated configuration of the upper cavity. Furthermore, and in general, the distance between the back of disposable razor heads and their stem seems to vary between 6 and 10 mm which is way smaller than what is illustrated in Manabat's patent FIG. 7 element 28 and 38. To compensate for that, the bristles of the elongated brush would have to be long, and bent at their mid-section. The bristles will also have to be strong but flexible enough to be able to wipe the grime off the blades. With all that being said, the bristles will not be able to remove the grime between the upper and lower blades as the latter ones, in many disposable razors, are covered by the housing of the razor head.

SUMMARY OF THE INVENTION

The present idea is a container that can hold water or any other non toxic cleaning liquid, and houses a brush inside it designed to remove the grime or shaving clips stuck between the blades of a razor by ways of scrubbing the razor head against the brush. A cover complements this container with additional accessories providing a complete shaving and grooming experience. As previously mentioned, the exterior design, and additional features on this container will vary depending on the model and the target market.

Solution to the Problem

The present product brings about a better shaving experience for those who use either double edge safety manual razors or multiple blade disposable ones. This present product is designed to help clean a razor head faster during the shaving process without getting the sink too messy. This product completely eliminates the need to hit the razor's handle against the edge of a bathroom countertop sink causing unnecessary noises when expelling the grime stuck between the blades, and preventing the grime from splattering all over the sink bowl. Another benefit of this idea is a reduction in water usage needed to clean the blades during the shaving process.

So how does this idea save the user water and bring about a quieter and more efficient cleaning process? The answer resides in a cleaning container that houses a brush submerged in water. This container is filled once before shaving, and then rinsed once after shaving. There is no need to ever hit the razor's handle against the edge of a bathroom countertop sink or to rely on the weak water pressure supplied by a water faucet to clear the grime.

As mentioned above, this Cleaning receptacle's main functionality is having a brush mounted inside this container by means of snap fit brackets, and that is designed to clean the blades on a manual razor. This brush is submerged in water with its fine bristles facing up vertically or at an angle to make direct contact with the razor head. The action of gently scrubbing the razor head against the brush causes the bristles to penetrate the gap between the blades forcing the stubborn grime out. The overall form factor, material selection, and finish of this cleaning receptacle will depend on the target market segment.

As the product evolves, more configurations and features will be offered to answer the needs of a larger consumer base. For example, a fancier version of this cleaning receptacle could offer features such as a sharpening tool, a razor holder, a shaving soap, some after shave towelettes, a drying tray accessory, a mirror, as well as a light fixture. Grooming and dental accessories will also be included and stored in the cavities forming this all purpose cleaning receptacle apparatus. A travel edition model will also be offered in a small form factor designed to fit in a travel case or a backpack.

This concept of a cleaning receptacle for double edge safety or disposable razors can be extended to cleaning any submersible small object with intricate features in order to remove some stubborn residue or gunk of any kind. One example of such cleaning application would be to clean an artist's paint brush when switching gouache pigments, or to clean a small tool, or any object that can be dipped in water or any non toxic cleaning solution.

The general idea behind this concept is that a brush is placed inside a container designed to remove the grime stuck between the blades on a manual razor. This concept not only provides an effective, and noiseless way to clean the blades, but it substantially reduces water usage during the shaving process.

Description of the Solution

The main feature on this present idea is a container that is large and tall enough to house a brush, and gives ample room for the user to dip and scrub the razor's head preferably in a lengthwise direction to force the grime out. This container can be in the form of a single or multiple cavity one.

The outer bottom face of this container is designed to be flat for stability purposes. This container can be treated at its base with a silicon like surface finish or simply have a thin rubber mat applied to the bottom of the base. This treatment will allow the container to remain in place when the razor head is stroked lengthwise against the brush. The overall footprint of this product is small enough to sit on a bathroom counter, or on the rim of a bathtub.

In further examination we can see a brush inside this container. This brush is submerged and its bristles face up towards the surface of the water and are designed to make direct contact with the blades on a razor. This brush is either built in or mounted into the container by way of snap-fit design brackets. This container can have one or more compartments depending on the selected model and application. In this present application, a dual compartment container will allow the razor head to be scrubbed in one compartment containing the brush, while the other one can be used to clear the foam and grime from the razor head.

DETAILED DESCRIPTION OF THE INVENTION

Figure 1:
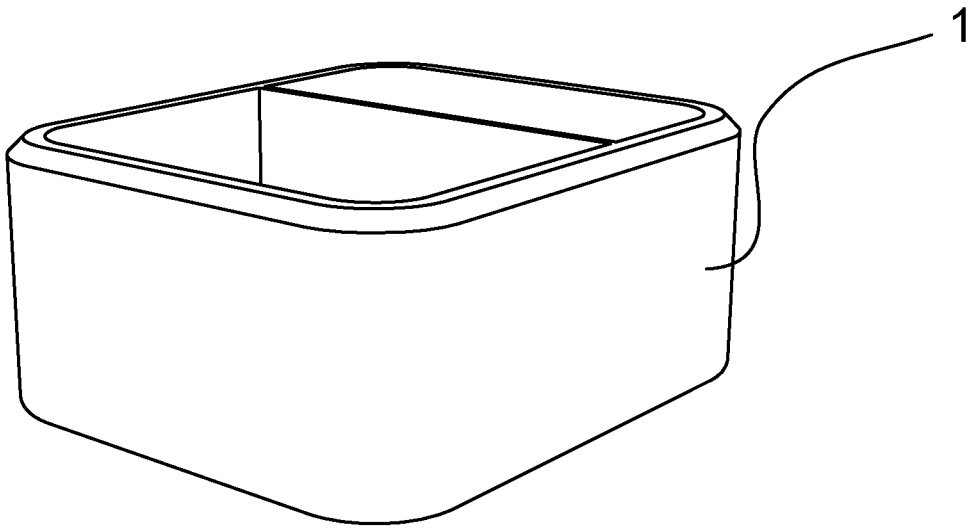
FIG. 1 is a perspective view of the cleaning container.
Figure 2:
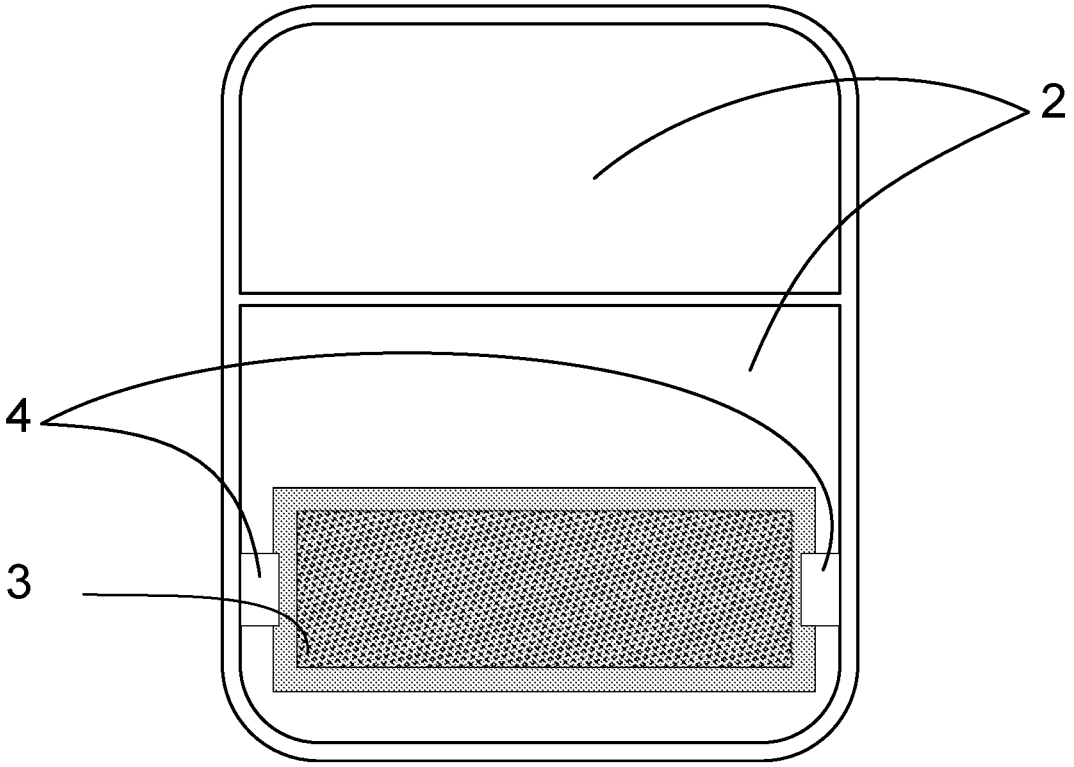
FIG. 2 is a top view of the cleaning receptacle showing both cavities and the cleaning brush.
Figure 7:
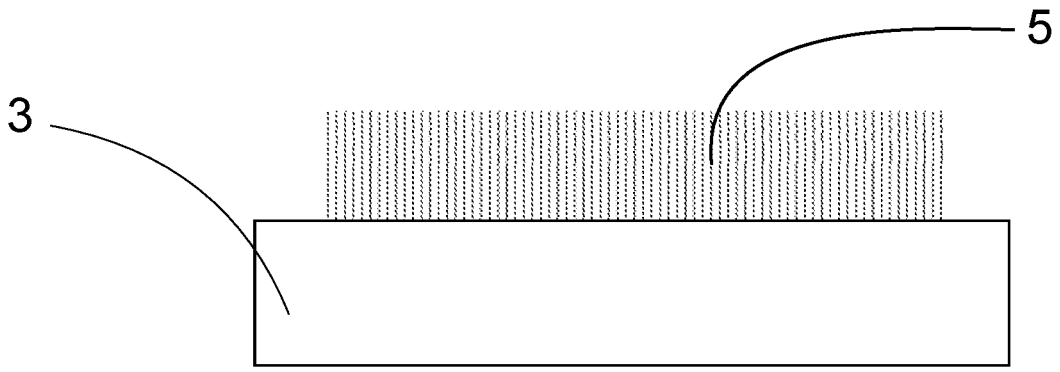
FIG. 7 is a side view of the snap on brush with the bristles facing up.

Referring now to the invention in more details, in FIG. 1, there is shown a main container 1 of about 60 mm or larger width in outside dimension, and about 100 mm or longer in length, or divided into two cavities adjacent to each other as in 2 illustrated in FIG. 2 of about 20 mm or more in depth and is large enough to house a cleaning element such as a brush FIG. 7.

Figure 5:
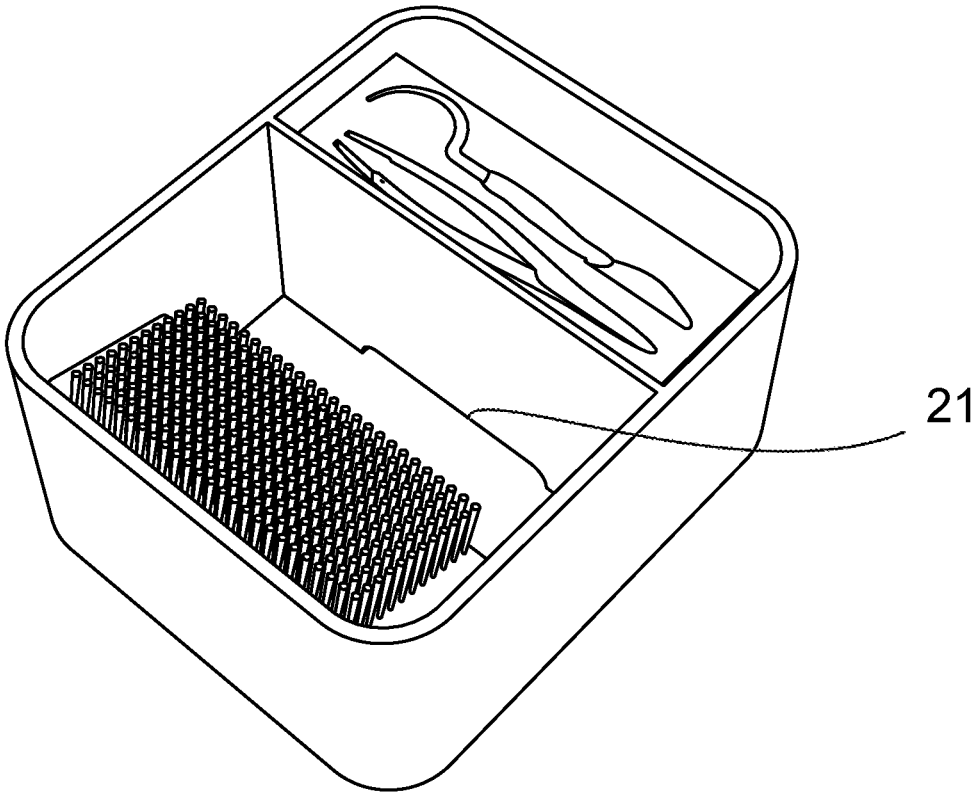
FIG. 5 is a perspective view of the cleaning container containing grooming and dental accessories.
Figure 6:
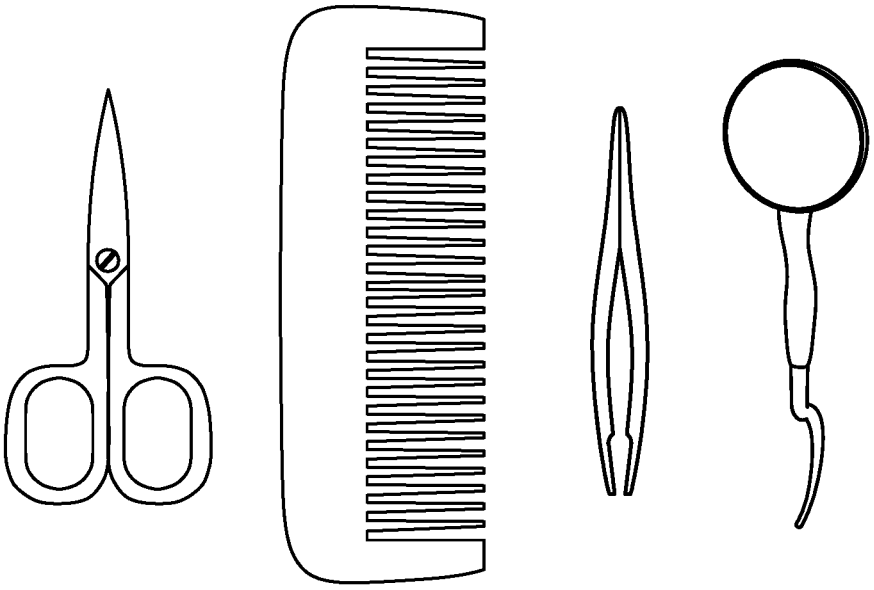
FIG. 6 is a top view of the shaving, grooming, and dental accessories
Figure 16:
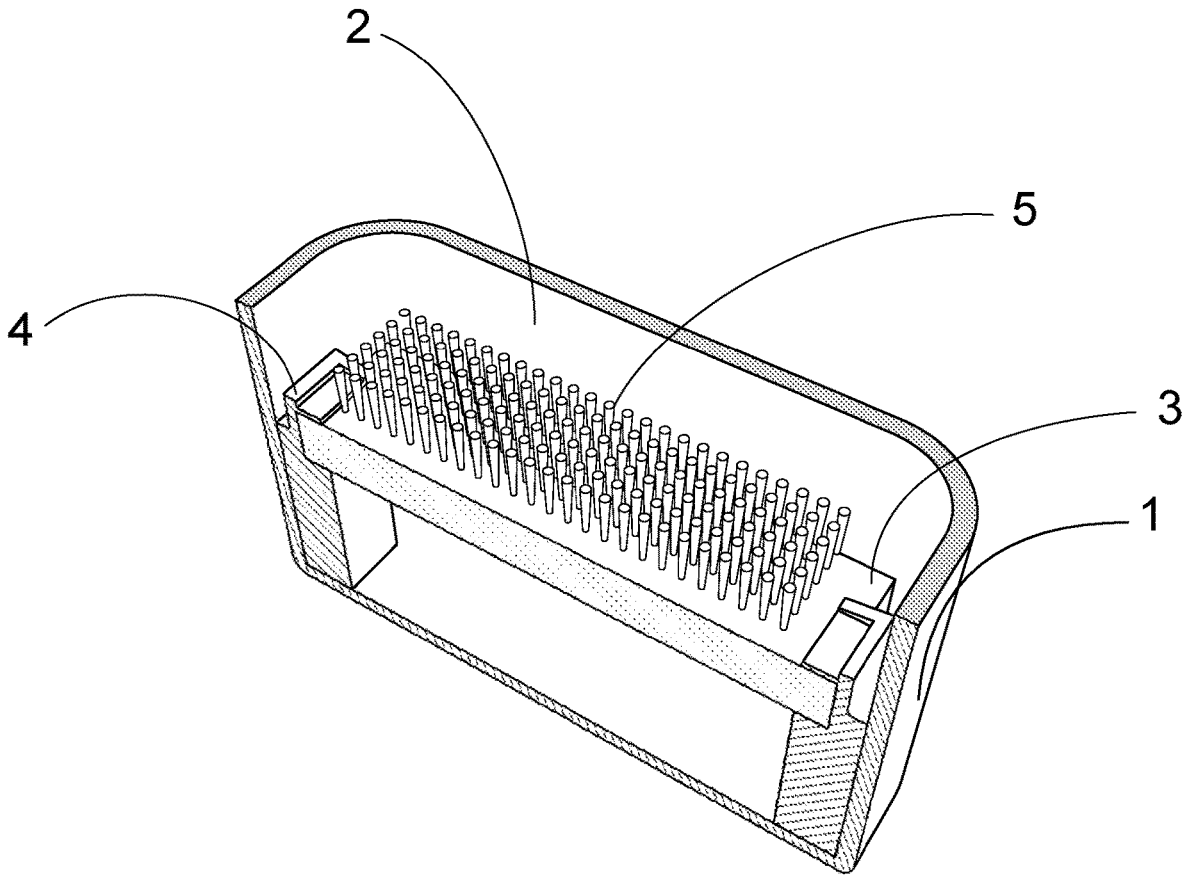
FIG. 16 is a cutaway view of the cleaning receptacle showing the snap fit connections.
Figure 17:
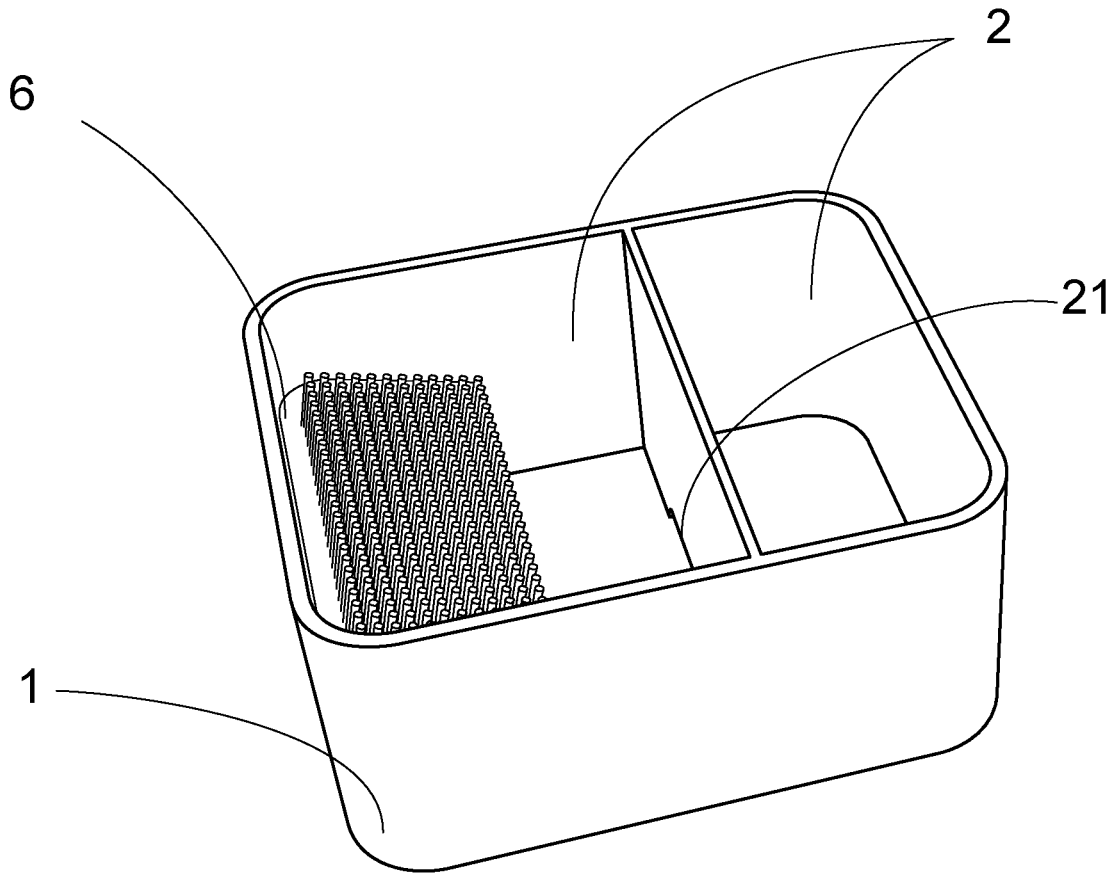
FIG. 17 is an orthographic view of the cleaning container with its built in brush.
Figure 18:
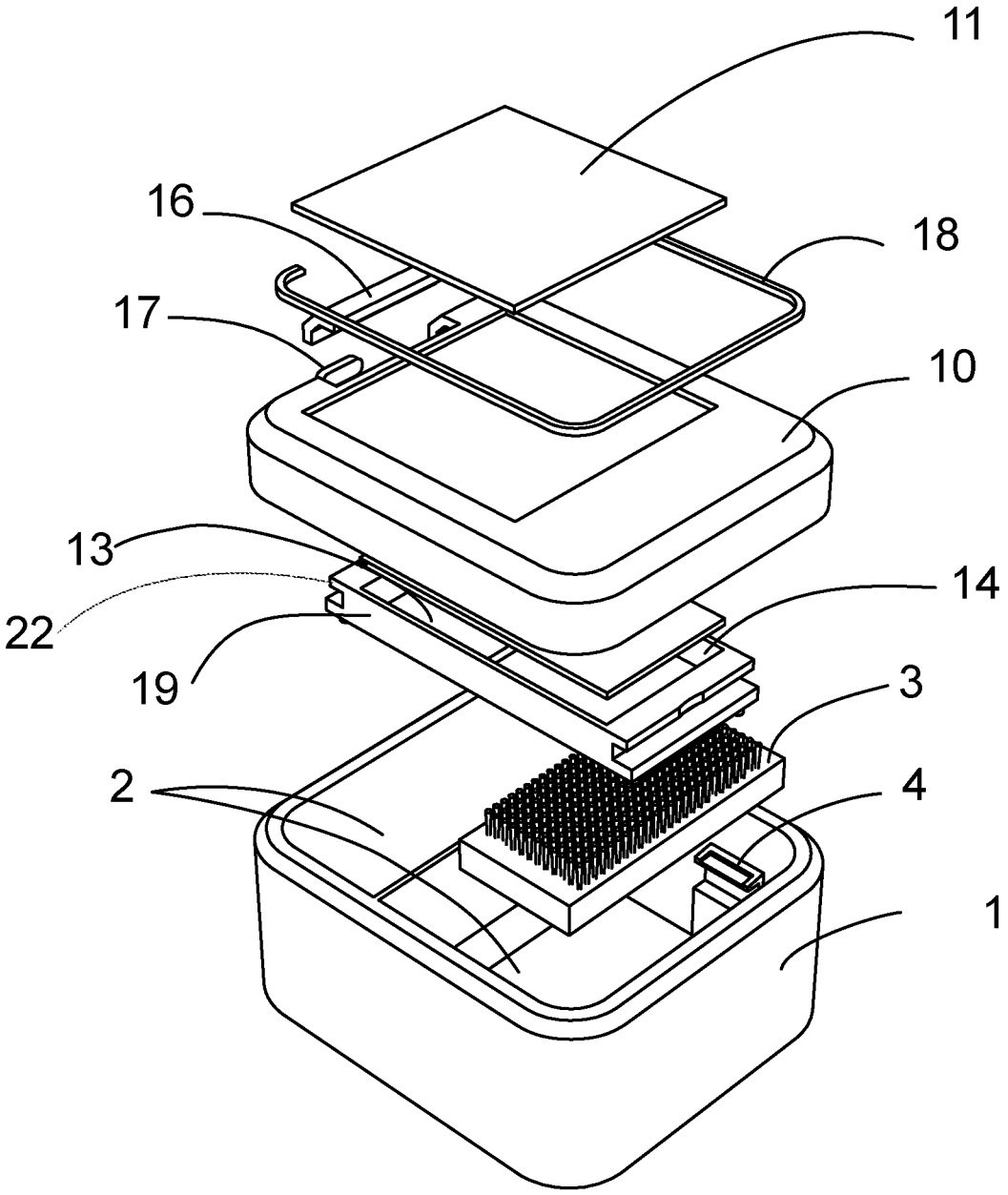
FIG. 18 is an exploded perspective view of the product.

Still referring to the cavities, in this container FIG. 1, we can observe a single or dual cavities 2 depending on the selected model as presented in FIG. 2. In further examination of the cavities, we notice that they are connected through an opening 21 as seen in FIG. 17 located at the bottom of the dividing wall, allowing the user to fill this said cleaning container at once from either cavity. We can also notice some built-in extrusions 4 in the shape of snap fit joint designs FIG. 16, allowing the brush 3 represented in FIG. 7, to snap into place for final assembly FIG. 18. Other design variations of this cleaning receptacle will show a built-in brush 6 FIG. 17, would not require any fittings of any kind as it is directly built into one of this container's compartments. The two main cavities functionality of this all purpose cleaning container can be used to store small dental and grooming accessories needed on a daily or occasional basis FIG. 5, and FIG. 6.

Figure 3:
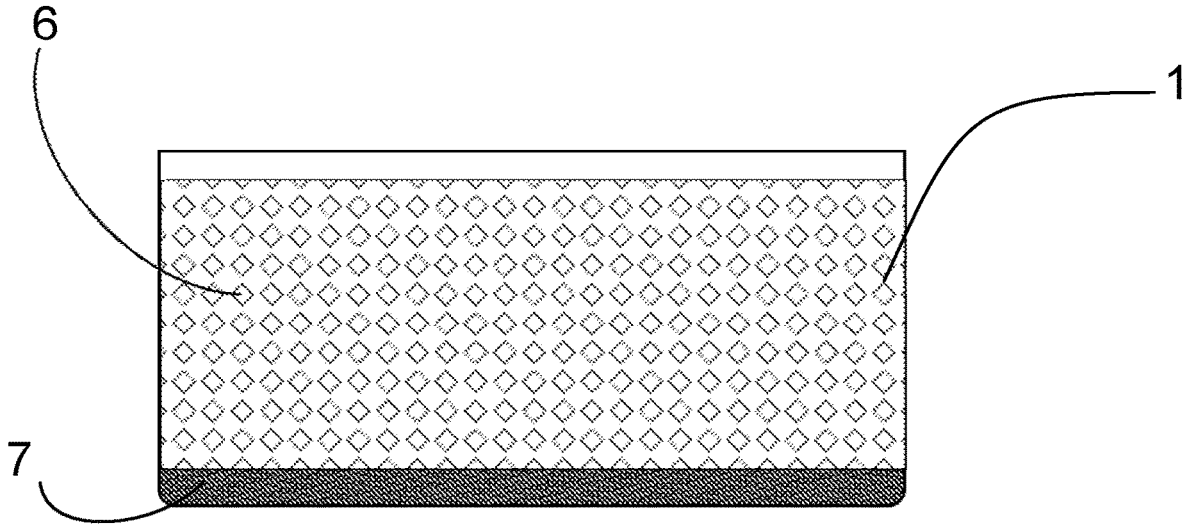
FIG. 3 is a side view of the cleaning container showing the outside wall design pattern.

Looking now at the external physical attributes of this container in FIG. 3, we notice that this container's exterior side can be treated with a smooth or textured surface or even some 3D ornamental design reliefs 6 for an added design perception value. The bottom face can be treated with a non-slip texture or material on the external side of this all purpose cleaning container for added stability Referring now to the brush 3 in FIG. 7, which is about 70 mm long, and about 40 mm or wider that is made of a group of fine bristles 5 of about 10 mm in length set in an array of rows covering the base of the brush. These are fine bristles, facing the surface of the water, and just below the latter to make direct contact with the razor blades, but are hard enough not to collapse when brushing away the gunk stuck between the blades. The surface of the brush FIG. 2 making contact with the razor blades is wide enough to provide ample room for the user to scrub the razor head from one end to the other without hitting the container's walls.

Figure 8:
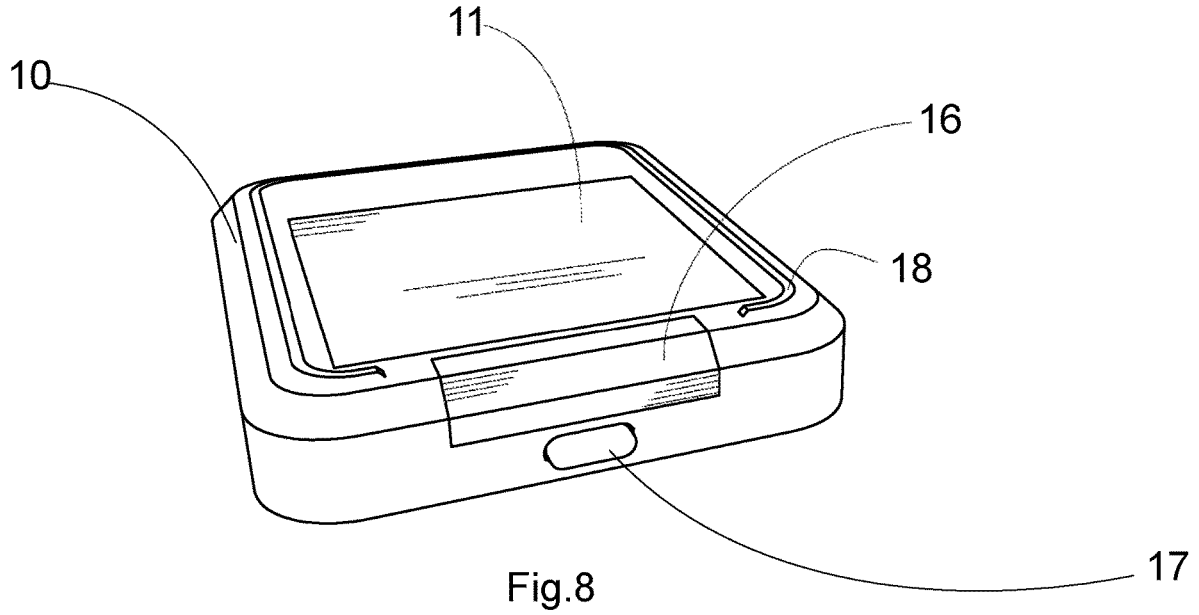
FIG. 8 is a perspective view of the cleaning receptacle lid showing a mirror, a light with a switch, and an anti-slip silicone strip.
Figure 9:
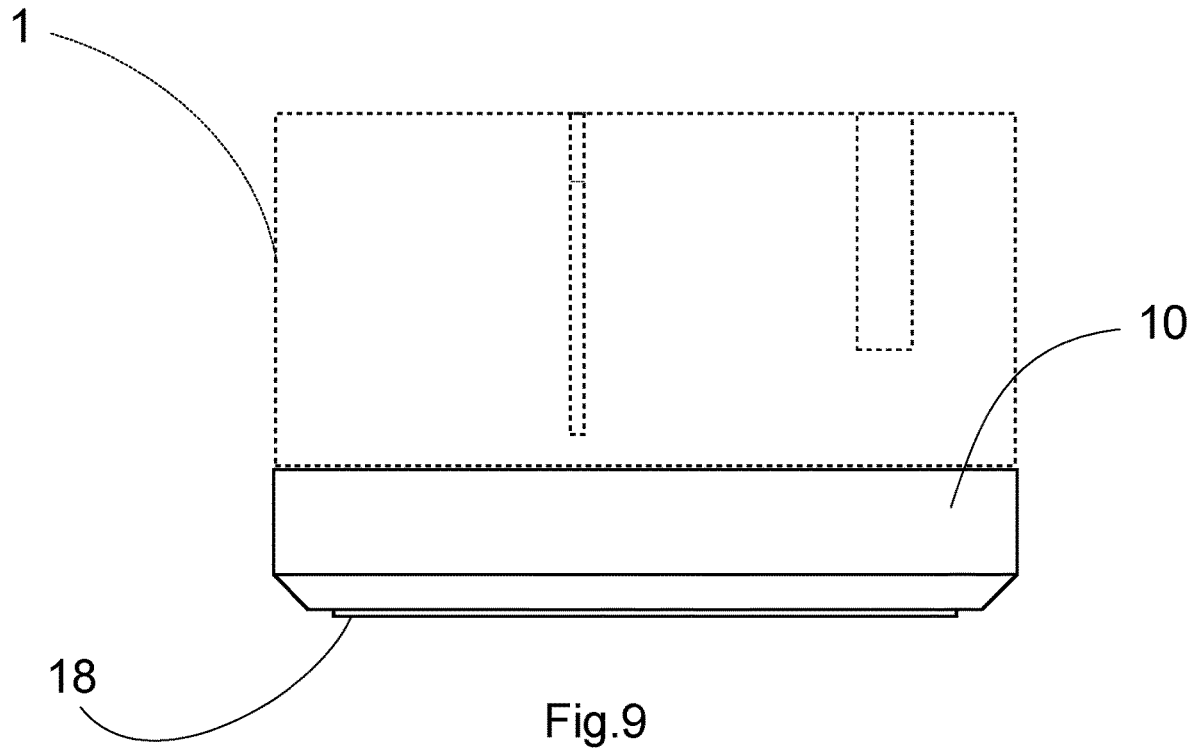
FIG. 9 is a side view of the lid used as a drying tray treated with an anti-slip silicone strip.
Figure 10:
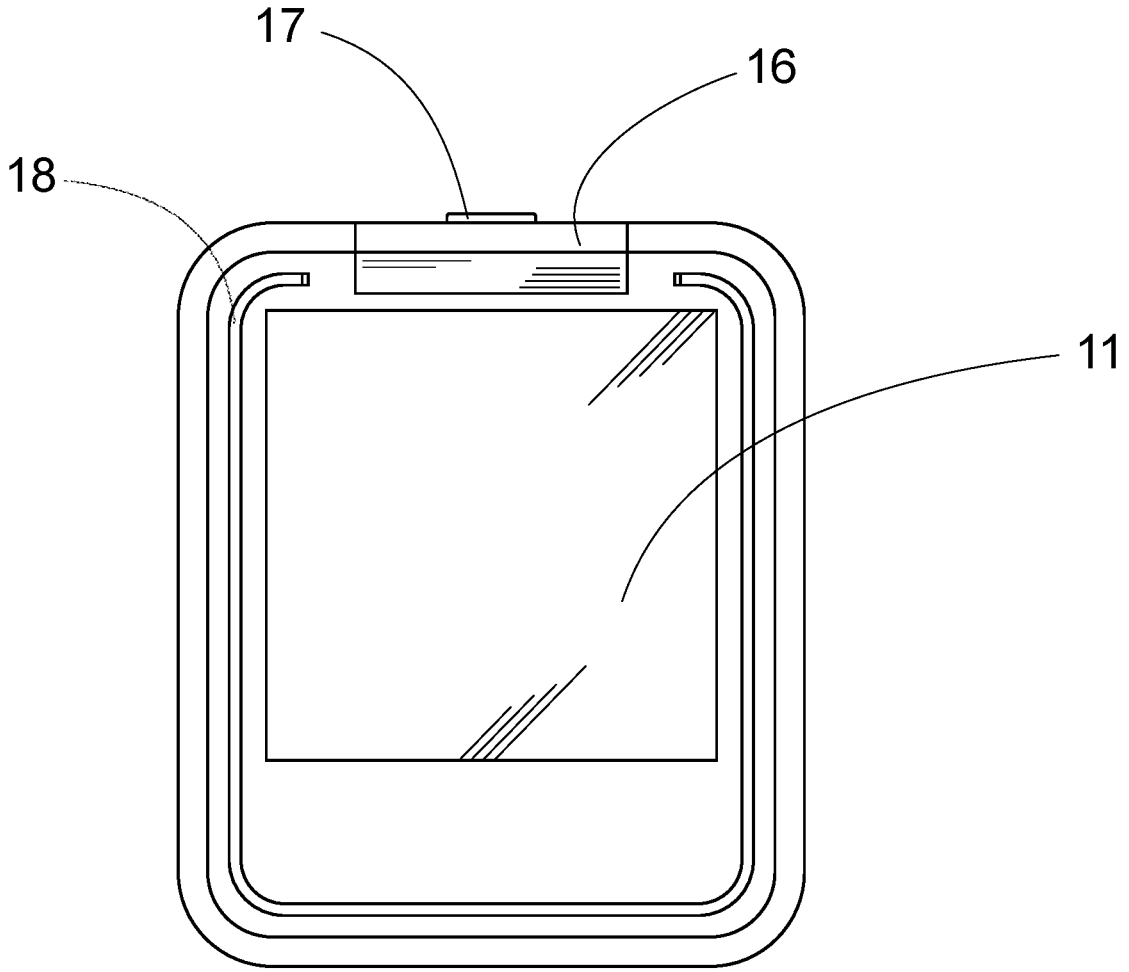
FIG. 10 is a top view of the cleaning receptacle lid showing a mirror, a courtesy light with a switch, and an anti-slip silicone based strip.
Figure 11:
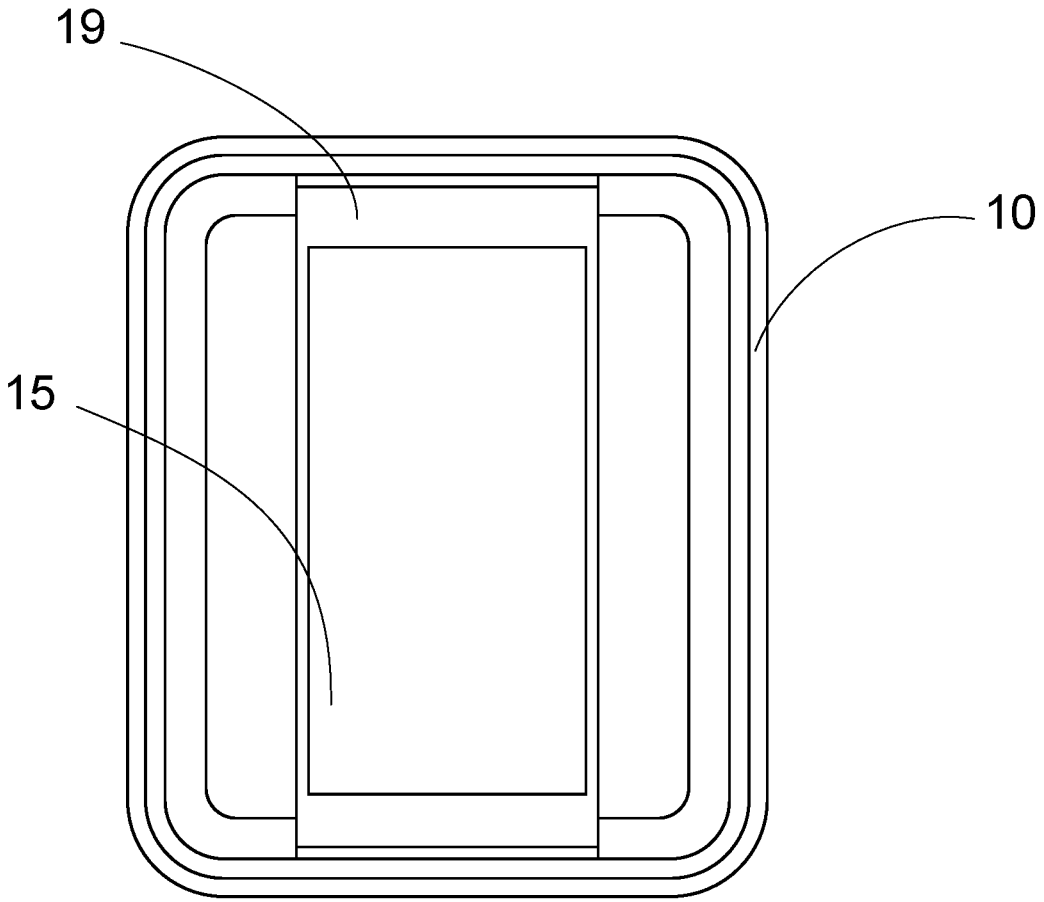
FIG. 11 is a bottom view of the cleaning receptacle lid showing the soap and after shave holding apparatus with its protective cover.
Figure 12:
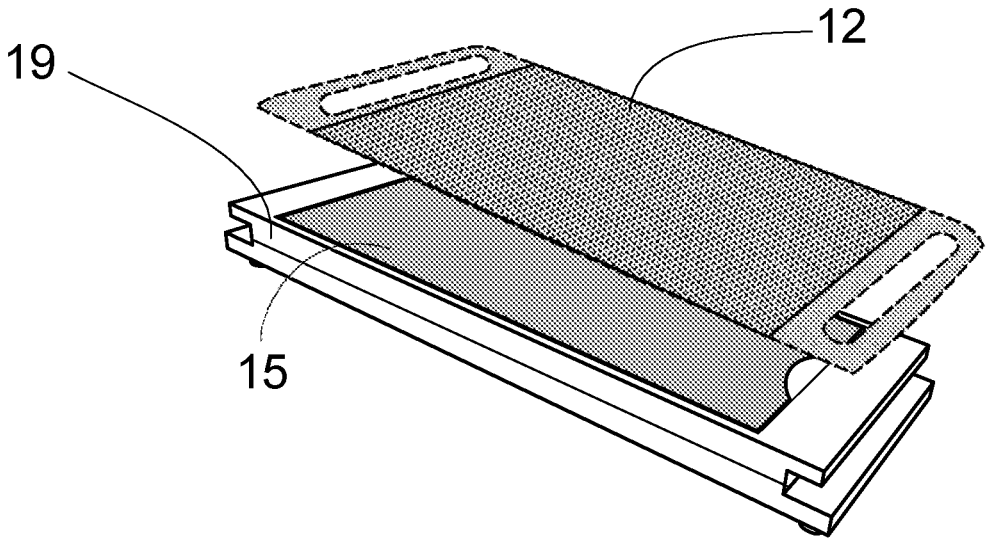
FIG. 12 is a perspective view of the soap and after shave container apparatus with its cover, and the blade sharpening strop.
Figure 13:
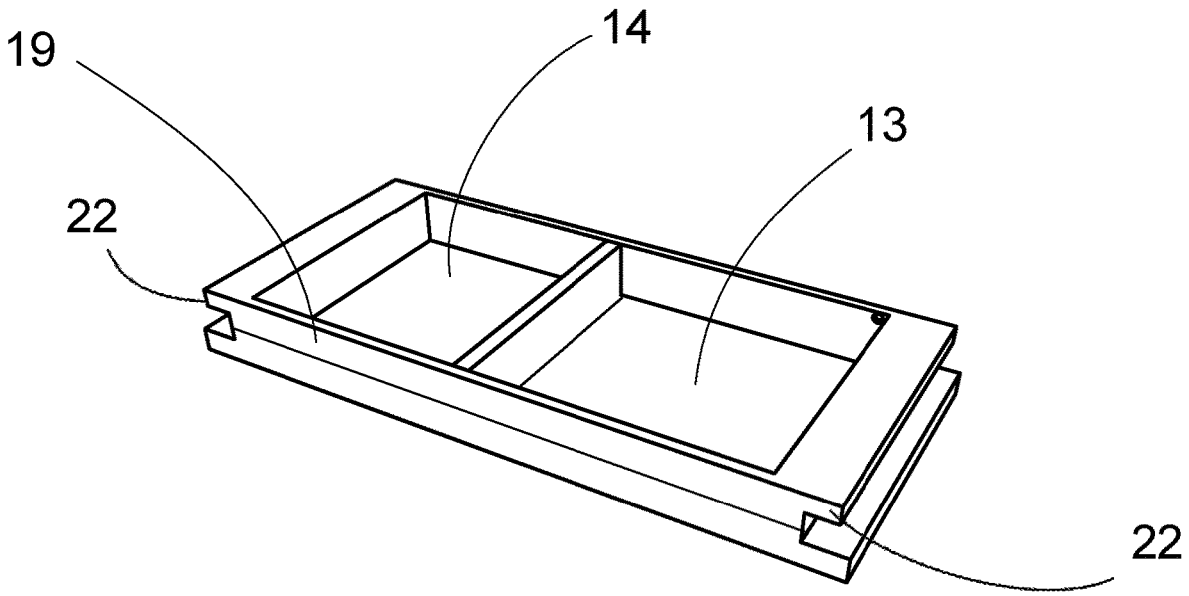
FIG. 13 is a perspective view of the soap and after shave container apparatus without its cover.

Referring now to the container lid FIG. 10 which functions as 10 a drying tray FIG. 9 accessory combining 11 a mirror FIG. 10, 12 a sharpening tool FIG. 11, 13 a soap holder FIG. 13, 14 aftershave cream or towelettes compartment FIG. 13, a shaving soap container cover 15 FIG. 12, and finally a light fixture 16, activated by a switch 17 FIG. 10. This container lid FIG. 8 is designed to embody all of the above features in accordance with the present invention of improving the shaving process.

When the shaving process is completed, the said all purpose cleaning receptacle can be rinsed, and turned over to sit on top of the interior side of the lid 10 which functions as a drying tray FIG. 9 to allow any remaining moisture to drip from the cleaning receptacle onto the tray.

The drying tray functionality of the interior side of said lid 10 FIG. 11 extends into two structural apparatus compartments adjacent to each other 19 FIG. 13 that function as a storage for a travel size shaving soap, and after shave towelettes FIG. 13. The compartments lid cover 15 FIG. 12 of this structural apparatus forms a sitting base that allows the strop 12 FIG. 14 to lay flat, and wraps around the hook like ends 22 FIG. 13 of the structural storage compartments apparatus 19 FIG. 13 to remain stretched when stropping the razor blade against it.

The exterior face of the all purpose container lid houses a mirror FIG. 10 that is recessed from the surface to prevent it from being scratched. A thin or wide strip 18 made of silicone is molded as an added protective trim that is offset at about 10 mm or more from the perimeter of the lid. A small battery operated light 16 FIG. 10 is integrated into the lid to offer added brightness under poor lit environments. This light is activated through a discrete switch 17 as shown in FIG. 8 and FIG. 10 and integrated into the lid 10.

Figure 14:
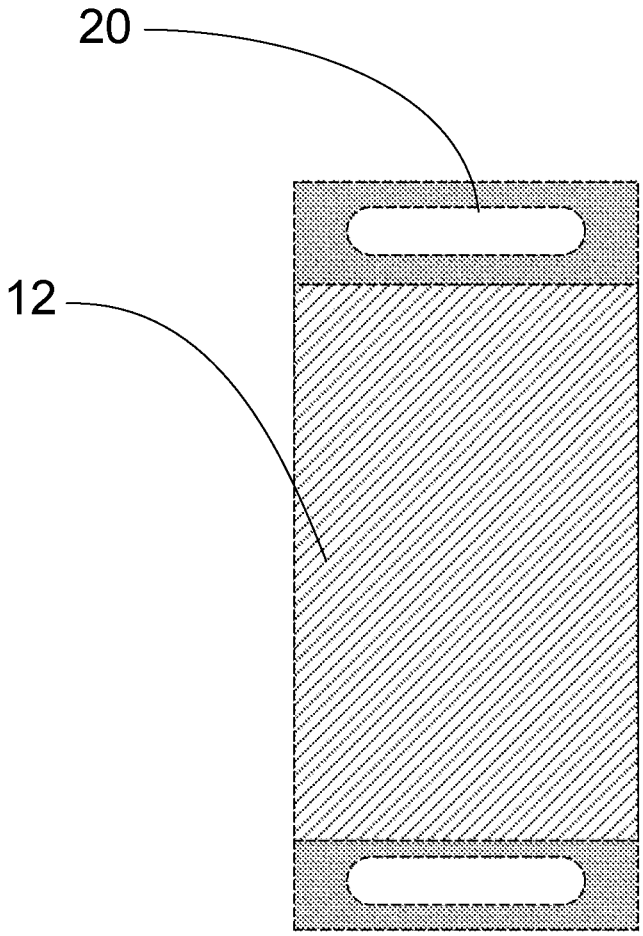
FIG. 14 is a top view of the strop, showing the sharpening material in center with its two attaching ends.
Figure 15:
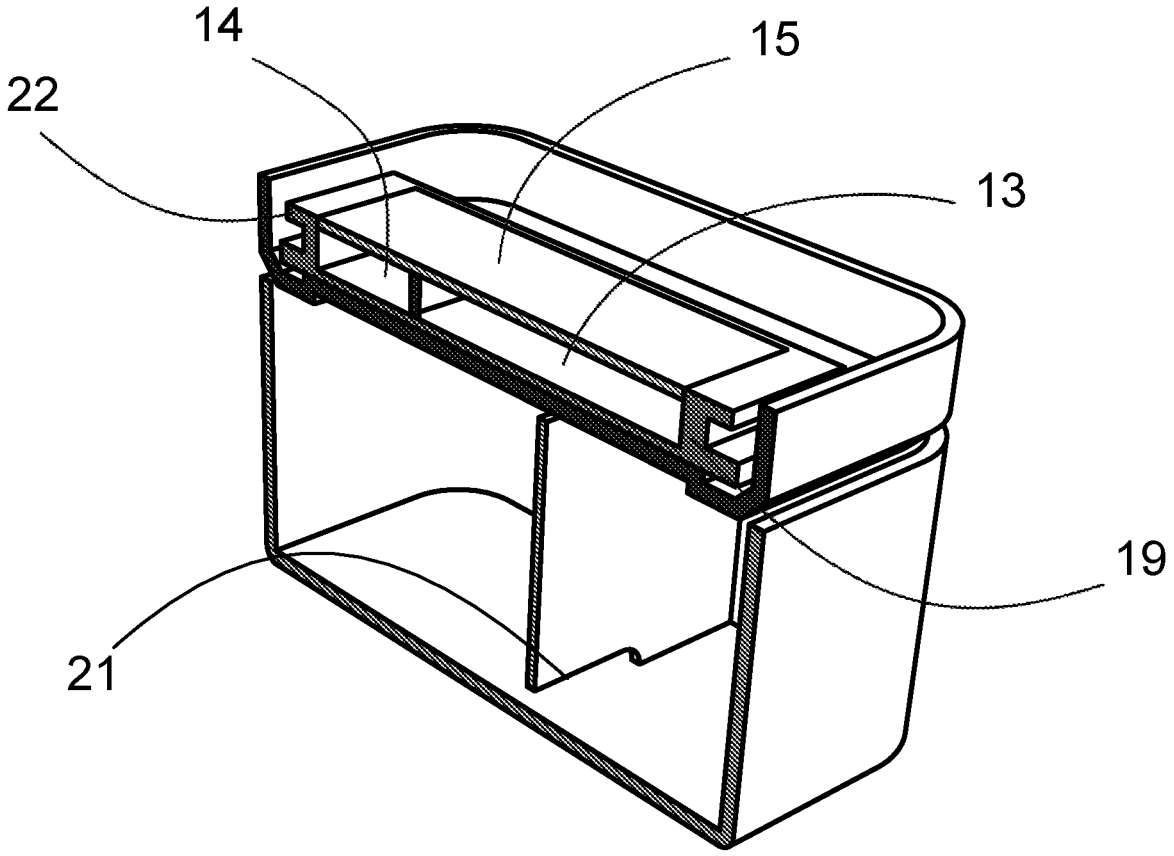
FIG. 15 (NEW) is a shaded cross section of both the all purpose cleaning container, and its cover sitting inside out to reveal the soap and after shave towelettes compartments.

A strop 12 FIG. 14 is located on top of the shaving soap compartment apparatus 19 FIG. 12 and is supported by the shaving soap compartment cover 15 FIG. 12 and FIG. 15 (NEW) to offer an even level sharpening of the blades. The said strop 12 FIG. 14 is affixed to the soap compartment apparatus FIG. 12 by means of stretching one end of the strop's hook or opening 20 FIG. 14 to the hook like ends 22 of the shaving soap, and towelettes compartment apparatus 19 structural apparatus FIG. 13.

Figure 4:
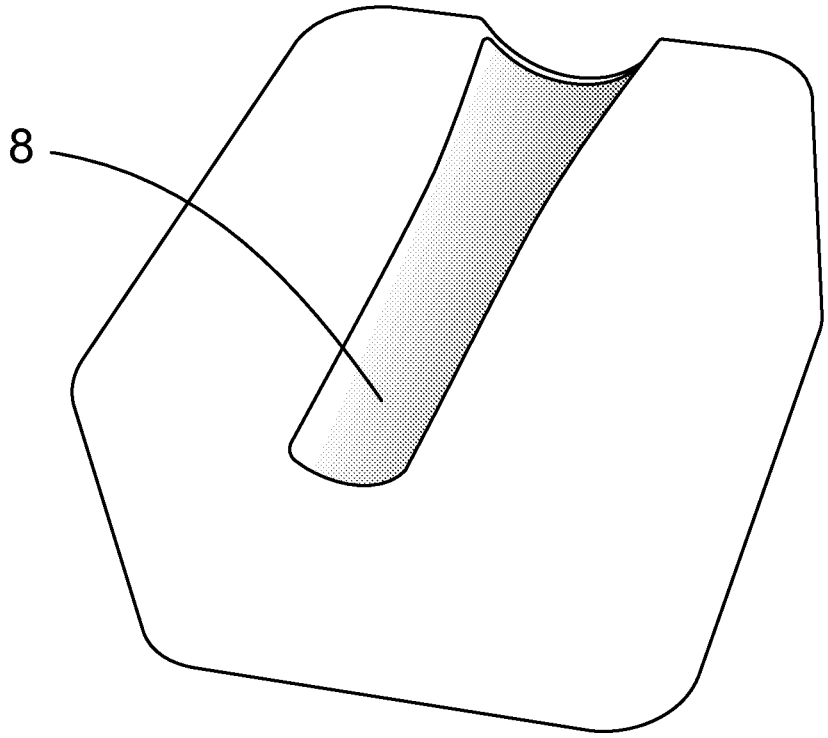

Finally, a razor holder that is built into the cleaning receptacle 21 FIG. 4 (NEW) allowing to hold the razor in place so it can dry once the shaving process is completed.

The advantages of this present idea include, without limitation, that it is small enough to sit on a 275 bathroom counter-top sink or the rim of a bathtub.

In broad embodiment, the present invention is a container having a brush inside designed to clear the 276 grime lodged between the blades on a disposable razor.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention as claimed.

The invention claimed is:

1. A cleaning container cover apparatus that functions as a drying tray comprising: a mirror recessed on a cover exterior side and surrounded by a raised silicone strip preventing the mirror from being scratched;

a first compartment built into an interior side of the cover, wherein a shaving soap is positioned within the first compartment;

a second compartment, independent from the first compartment, build into the interior side of the cover, wherein after shave towelettes are positioned within the second compartment;

a lid cover positioned on the interior side of the cover to cover the first and second compartments, wherein a blade sharpening tool is attached to the lid cover; and a light source integrated into the cleaning cover apparatus.

* * * * *